US008794196B2

(12) United States Patent
Shimokawa et al.

(10) Patent No.: US 8,794,196 B2
(45) Date of Patent: Aug. 5, 2014

(54) CHAIN SAW

(75) Inventors: Koichi Shimokawa, Kawagoe (JP); Kiminobu Sato, Kawagoe (JP)

(73) Assignee: Husqvarna Zenoah Co., Ltd., Kawagoe-shi, Saitama (JP)

( * ) Notice: Subject to any disclaimer, the term of this patent is extended or adjusted under 35 U.S.C. 154(b) by 570 days.

(21) Appl. No.: 12/245,868

(22) Filed: Oct. 6, 2008

(65) Prior Publication Data

US 2010/0083511 A1 Apr. 8, 2010

(51) Int. Cl.
*F01P 5/02* (2006.01)
*B27B 17/00* (2006.01)

(52) U.S. Cl.
USPC ..... 123/41.65; 123/41.7; 30/381

(58) Field of Classification Search
USPC ..... 123/198 E, 41.63, 41.66, 41.65, 41.7, 123/192.1, 41.56; 417/363; 55/437; 30/381
See application file for complete search history.

(56) References Cited

U.S. PATENT DOCUMENTS 238,947 A * 3/1881 McLennan et al. ..... 416/182
1,090,239 A * 3/1914 Scott ..... 415/199.4
2,827,932 A 3/1958 Strunk
3,678,973 A 7/1972 Loop
3,679,323 A * 7/1972 Buck ..... 416/183
3,974,566 A 8/1976 Pilatowicz
3,994,067 A 11/1976 Hazzard et al.
4,010,544 A 3/1977 Siman
4,060,985 A 12/1977 Fukushima
4,142,607 A 3/1979 Landwehr et al.
4,370,855 A 2/1983 Tuggle
4,382,333 A 5/1983 Nagashima et al.
4,406,066 A 9/1983 Itzrodt
4,413,705 A 11/1983 Inaga et al.
4,450,933 A 5/1984 Fukuoka et al.

(Continued)

FOREIGN PATENT DOCUMENTS

EP 1 424 487 A2 6/2004
EP 1 967 337 A1 9/2008

(Continued)

OTHER PUBLICATIONS

Related U.S. Appl. No. 12/245,876, filed Oct. 6, 2008; Inventors: Koichi Shimokawa et al; Title: Chain Saw.

(Continued)

*Primary Examiner* — Lindsay Low
*Assistant Examiner* — Jacob Amick
(74) *Attorney, Agent, or Firm* — Holtz Holtz Goodman & Chick PC

(57) ABSTRACT

A cooling fan includes: a hub; a plurality of cooling vanes provided along an outer circumference of the hub; and an annular connector for connecting the cooling vanes. The hub is provided with a through hole that axially penetrates the hub. A first cover on a case for covering an outward side of the cooling fan is provided with a first outer-air intake. A second cover for partitioning between the cooling fan and a crankcase and for covering an inward side of the cooling fan is provided with a second outer-air intake. With this arrangement, even when one outer-air intake (for instance, the first outer-air intake) adjacent to where the cooling vanes are provided is clogged by a large amount of dust generated during operations, the cooling vanes can breathe from the non-clogged other outer-air intake (for instance, the second outer-air intake) through the through hole, thereby restraining reduction in air flow.

11 Claims, 7 Drawing Sheets

(56) References Cited

U.S. PATENT DOCUMENTS

| | | | | |
|---|---|---|---|---|
| 4,482,028 | A | 11/1984 | Fukuoka et al. | |
| 4,592,445 | A | 6/1986 | Sawada | |
| 4,594,083 | A | 6/1986 | Hiraizumi | |
| 4,727,651 | A | 3/1988 | Nakajima | |
| 4,765,282 | A | 8/1988 | Nagashima | |
| 4,787,924 | A | 11/1988 | Nagashima et al. | |
| 4,928,651 | A * | 5/1990 | Kronich | 123/196 AB |
| 4,936,271 | A | 6/1990 | Nagashima et al. | |
| 5,018,492 | A | 5/1991 | Wolf et al. | |
| 5,029,393 | A | 7/1991 | Nagashima et al. | |
| 5,080,048 | A | 1/1992 | Kudo | |
| 5,199,389 | A | 4/1993 | Wolf et al. | |
| 5,212,886 | A | 5/1993 | Tasaki | |
| 5,215,049 | A | 6/1993 | Wolf | |
| 5,243,764 | A | 9/1993 | Wieland | |
| 5,315,075 | A | 5/1994 | Junginger et al. | |
| 5,373,119 | A | 12/1994 | Suzuki et al. | |
| 5,595,153 | A | 1/1997 | Höppner et al. | |
| 5,722,237 | A | 3/1998 | Iida et al. | |
| 5,727,506 | A | 3/1998 | Tajima et al. | |
| 5,857,329 | A | 1/1999 | Bigham | |
| 6,112,708 | A | 9/2000 | Sawada et al. | |
| 6,216,650 | B1 | 4/2001 | Noguchi | |
| 6,314,922 | B1 * | 11/2001 | Zimmermann et al. | 123/41.65 |
| 6,514,052 | B2 * | 2/2003 | Bostwick | 417/366 |
| 6,537,030 | B1 * | 3/2003 | Garrison | 416/185 |
| 6,637,117 | B2 | 10/2003 | Kobayashi | |
| 6,896,245 | B2 | 5/2005 | Suzuki et al. | |
| 6,910,550 | B2 | 6/2005 | Schlossarczyk et al. | |
| 6,955,042 | B1 | 10/2005 | Wnuck et al. | |
| 6,955,152 | B2 | 10/2005 | Uhl et al. | |
| 7,156,202 | B2 | 1/2007 | Assad | |
| 7,341,027 | B2 * | 3/2008 | Sugiyama | 123/41.65 |
| D573,860 | S | 7/2008 | Shimokawa et al. | |
| D576,005 | S | 9/2008 | Shimokawa et al. | |
| D577,557 | S | 9/2008 | Shimokawa et al. | |
| 7,578,369 | B2 | 8/2009 | Francisco et al. | |
| 7,946,040 | B2 | 5/2011 | Sugishita | |
| 2001/0039736 | A1 * | 11/2001 | Husges et al. | 30/276 |
| 2003/0075123 | A1 | 4/2003 | Araki et al. | |
| 2003/0075132 | A1 | 4/2003 | Ohsawa et al. | |
| 2003/0173148 | A1 | 9/2003 | Andersson et al. | |
| 2003/0183208 | A1 | 10/2003 | Nara et al. | |
| 2005/0183270 | A1 | 8/2005 | Schmidt et al. | |
| 2009/0000130 | A1 | 1/2009 | Shimokawa | |
| 2009/0007438 | A1 | 1/2009 | Shimokawa | |
| 2009/0100689 | A1 | 4/2009 | Shimokawa | |
| 2010/0083512 | A1 | 4/2010 | Shimokawa et al. | |
| 2010/0202887 | A1 * | 8/2010 | Bohl et al. | 416/183 |
| 2010/0322762 | A1 * | 12/2010 | Shirahama et al. | 415/204 |
| 2011/0072671 | A1 | 3/2011 | Tsuruoka | |

FOREIGN PATENT DOCUMENTS

| | | | |
|---|---|---|---|
| JP | 54-090795 | U | 6/1979 |
| JP | 57-39203 | U | 3/1982 |
| JP | 57-058282 | B2 | 12/1982 |
| JP | 60-012885 | Y2 | 4/1985 |
| JP | 63-021362 | Y2 | 6/1988 |
| JP | 2-34725 | U | 3/1990 |
| JP | 3-58281 | B2 | 9/1991 |
| JP | 03-052981 | Y2 | 11/1991 |
| JP | 5-33657 | A | 2/1993 |
| JP | 9-151739 | A | 6/1997 |
| JP | 2000-310123 | A | 11/2000 |
| JP | 3167318 | B2 | 3/2001 |
| JP | 3186836 | B2 | 5/2001 |
| JP | 2001-355446 | A | 12/2001 |
| JP | 2007-185894 | A | 7/2007 |
| JP | 2007-262984 | A | 10/2007 |
| WO | 2007/074822 | | 7/2007 |
| WO | 2007/081043 | A1 | 7/2007 |
| WO | 2007/081055 | A1 | 7/2007 |

OTHER PUBLICATIONS

K. Shimokawa, "Chain Saw", related U.S. Appl. No. 12/087,530, filed Jul. 9, 2008.

K. Shimokawa, "Chain Saw", related U.S. Appl. No. 12/087,571, filed Jul. 10, 2008.

* cited by examiner

CHAIN SAW

BACKGROUND OF THE INVENTION

1. Field of the Invention

The present invention relates to a chain saw.

2. Description of Related Art

According to a traditionally known arrangement of a portable work machine such as a chain saw, a cooling fan provided adjacent to a first end of a crankshaft conveys cooling air to a cylinder for cooling the cylinder (for instance, document 1: JP-A-2001-355446).

In the portable work machine according to the document 1, a cooling fan (a blade wheel of an air blower) includes a hub (a partition) and cooling vanes (an intake blade ring body) projected respectively from an inward side of the hub (a side opposed to the crankcase) and an outward side of the hub (a side not opposed to the crankcase). In addition, a case cover (a machine case) is provided with: a first outer-air intake (a first inflow opening) in direct communication with the outside of the portable work machine for feeding outer air to the outward side of the cooling fan; and a second outer-air intake (a second cooling-air inlet) in communication with the outside through an outer-air inlet (a second inflow opening) for feeding outer air to the inward side of the cooling fan.

According to such a portable work machine as disclosed in the document 1, even when a first one of the outer-air intakes is clogged by a large amount of dust and the like generated during operations (including when the outer-air inlet is clogged as far as the second outer-air intake is concerned), the cooling vanes adjacent to a second one (i.e., non-clogged one) of the outer-air intakes can breathe through the second one of the outer-air intakes. Thus, cooling air can be reliably conveyed to the cylinder.

However, according to the portable work machine of the document 1, only the cooling vanes adjacent to the non-clogged outer-air intake can breathe. Thus, when the first one of the outer-air intakes is clogged, only the cooling vanes adjacent to the second non-clogged one of the outer-air intakes breathes for conveying the air, so that air flow conveyed to the cylinder is reduced.

SUMMARY OF THE INVENTION

An object of the invention is to provide a chain saw capable of restraining reduction in air flow caused by clogging of an outer-air intake.

A chain saw according to an aspect of the invention includes: an engine; a cooling fan disposed on a lateral side of a crankcase of the engine and rotationally driven by the engine; and a case that accommodates the engine and the cooling fan, in which the cooling fan includes: a hub fixed on a crankshaft of the engine; a plurality of cooling vanes provided along an outer circumference of the hub; and an annular connector that connects the cooling vanes, the hub is provided with a through hole that axially penetrates the hub, the case includes: a first cover that covers an outward side of the cooling fan; and a second cover that covers an inward side of the cooling fan, the first cover is provided with a first outer-air intake that feeds outer air to the outward side of the cooling fan, and the second cover is provided with a second outer-air intake that feeds outer air to the inward side of the cooling fan.

According to the aspect of the invention, the hub is provided with the through hole. Thus, even when one outer-air intake (for instance, the first outer-air intake) adjacent to where the cooling vanes are provided is clogged by a large amount of dust generated during operations, the cooling vanes can breathe from the non-clogged other outer-air intake (for instance, the second outer-air intake) through the through hole. Accordingly, reduction in air flow due to clogging of the outer-air intakes can be restrained.

In addition, since the cooling fan is bored by forming the through hole therein, a diameter of the cooling fan can be increased without increasing the weight of the cooling fan, thereby increasing air flow. Accordingly, without increasing the weight of the cooling fan, reduction in air flow due to clogging of the outer-air intakes can be further restrained.

The outer-air intakes may be in direct communication with the outside of the chain saw, or may be in communication with the outside through an opening provided on the ease (i.e., an opening different from the outer-air intake). When the outer-air intakes are in communication with the outside through such a different opening provided on the case, clogging of the outer-air intakes includes clogging of the different opening. In addition, the "outward side of the cooling fan" means a side of the cooling fan not opposed to the crankcase while the "inward side of the cooling fan" means a side of the cooling fan opposed to the crankcase.

Preferably in the chain saw according to the aspect of the invention, the connector includes a central connector that connects substantially central portions of the cooling vanes, and the cooling vanes each include: a first cooling vane provided on an outward side of the central connector; and a second cooling vane provided on an inward side of the central connector.

According to the aspect of the invention, the cooling vanes are provided on both sides of the cooling fan. Thus, when one outer-air intake is clogged, the cooling vanes provided adjacent to the clogged outer-air intake can breathe from the non-clogged other outer-air intake through the through hole while the cooling vanes provided adjacent to the non-clogged other outer-air intake can breathe directly from the non-clogged other outer-air intake.

Thus, as compared to an arrangement where the cooling fan is provided with the cooling vanes only on the side adjacent to the clogged outer-air intake, this aspect of the invention can enhance breathing efficiency of the cooling fan all the more because the cooling vanes adjacent to the non-clogged outer-air intake(s) can breathe directly from the non-clogged outer-air intake without using the through hole. Accordingly, reduction in air flow due to clogging of the outer-air intakes can be more sufficiently restrained.

Preferably in the chain saw according to the aspect of the invention, the inward side of the central connector is provided with a pair of thick portions formed to be thick, an ignition magnet is accommodated in a first one of the pair of thick portions, and the central connector extends between the pair of thick portions while being flexed to outwardly bulge.

According to the aspect of the invention, since the central connector between the thick portions is flexed as if outwardly bulging, a section modulus of the cooling fan can be increased. Thus, the cooling fan can be prevented from being outwardly flexed under the weight of the weighty thick portions, thereby increasing air flow of the cooling fan. Accordingly, reduction in air flow due to clogging of the outer-air intakes can be further sufficiently restrained. Since flexing of the cooling fan can be prevented, quietness of the cooling fan can be enhanced.

DETAILED DESCRIPTION OF PREFERRED EMBODIMENT(S)

1. Overall Arrangement of Chain Saw

An exemplary embodiment of the invention will be described below with reference to the attached drawings.

Figure 1:
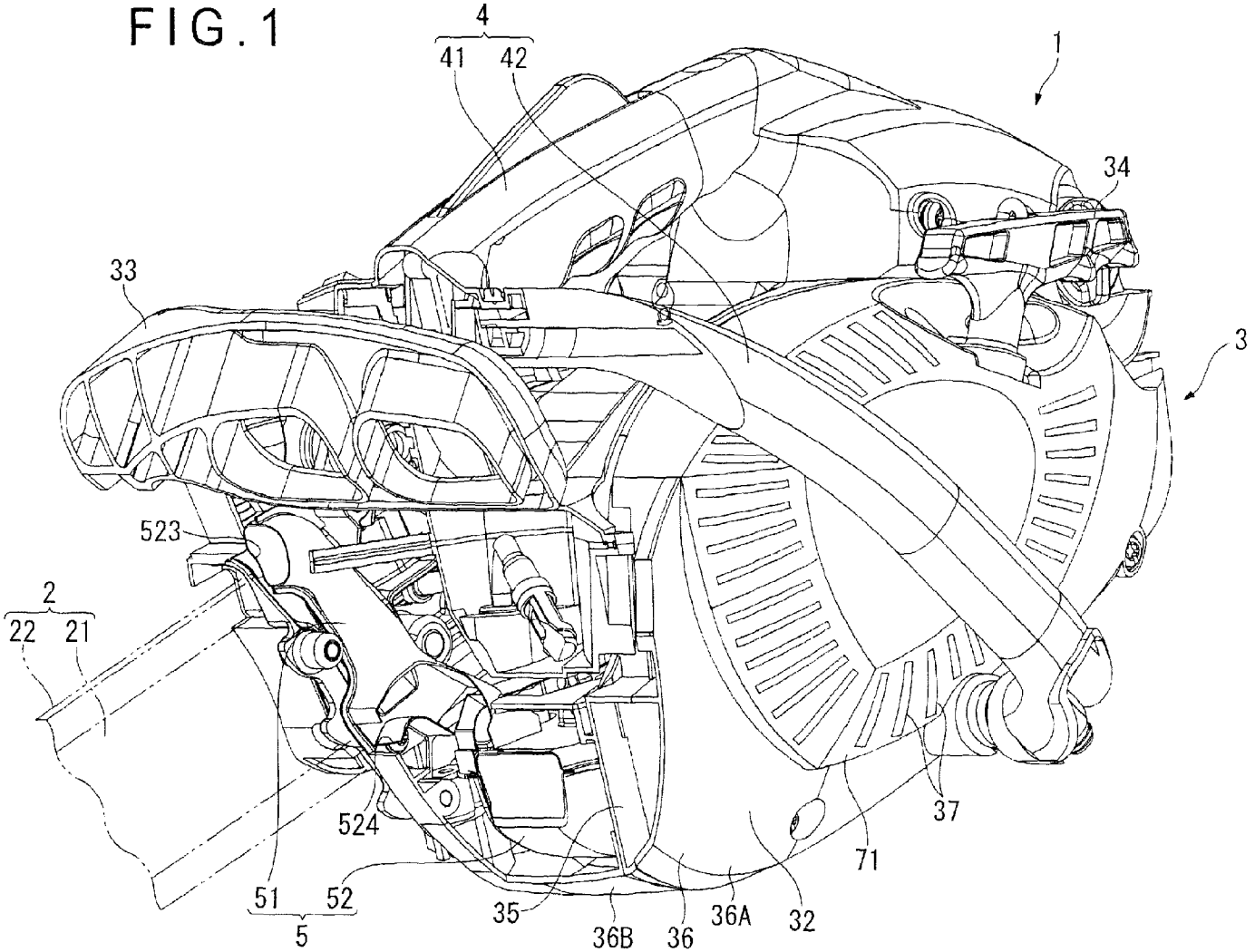
FIG. 1 is a perspective view showing an overall arrangement of a chain saw according to an exemplary embodiment of the invention.

FIG. 1 is a perspective view showing an overall arrangement of a chain saw 1 according to this exemplary embodiment. In FIG. 1, a front portion of a chain saw body 3 is shown in cross section.

The chain saw 1 includes a chain 2, the chain saw body 3 for driving the chain 2, and a handle 4 mounted on the chain saw body 3. The chain saw 1 according to this exemplary embodiment, a detail of which will be described later, is structured as a small machine having a two-cycle engine 31 (see FIG. 2) of approximately 35 cc. Hereinafter in this description, a direction in which the chain 2 protrudes will be referred to as front side, a direction opposite thereto will be referred to as rear side, a direction vertically perpendicular to the above-described front-and-rear direction will be referred to as up-and-down direction, and a direction horizontally perpendicular to the front-and-rear direction will be referred to as right-and-left direction.

2. Arrangement of Chain and Chain Saw Body

The chain 2 includes a plate-like guide bar 21 and a saw chain 22 wounds around the guide bar 21.

The chain saw body 3 includes an engine 31 and a case 32 made of synthetic resin for housing the engine 31 and the like. A front upper portion of the chain saw body 3 is provided with a hand guard 33 while a right portion of the chain saw body 3 is provided with a recoil-starter handle 34.

3. Arrangement of Case

The case 32 includes: a case body 35 in which the engine 31 and the like are installed (the case body 35 may also serve as a frame); and a case cover 36 mounted on the case body 35 for covering the engine 31 and the like. The case cover 36 includes a right side cover 36A mounted on a right side of the case body 35, and a muffler cover 36B mounted on a lower portion of the case body 35.

A later-described cooling fan 6 (see FIG. 4) is provided at an inner side of the right side cover 36A. The right side cover 36A is provided with a plurality of first outer-air intakes 37 each shaped like a slit for feeding outer air to the cooling fan 6. In the front portion of the case cover 36, a main exhaust outlet (not shown) is formed at a position corresponding to a main exhaust outlet 523 of a later-described muffler 5 while a sub exhaust outlet (not shown) is formed at a position corresponding to a sub exhaust outlet 524 of the muffler 5.

4. Arrangement of Handle

The handle 4 includes: a top handle 41 provided above the chain saw body 3; and a side handle 42 bridging between the top handle 41 and a lower portion of the right side cover 36A. When the chain saw is in use, an operator grips the top handle 41 with his one hand while gripping the side handle 42 with the other hand for operating the chain saw 1.

5. Arrangement of Engine

Figure 2:
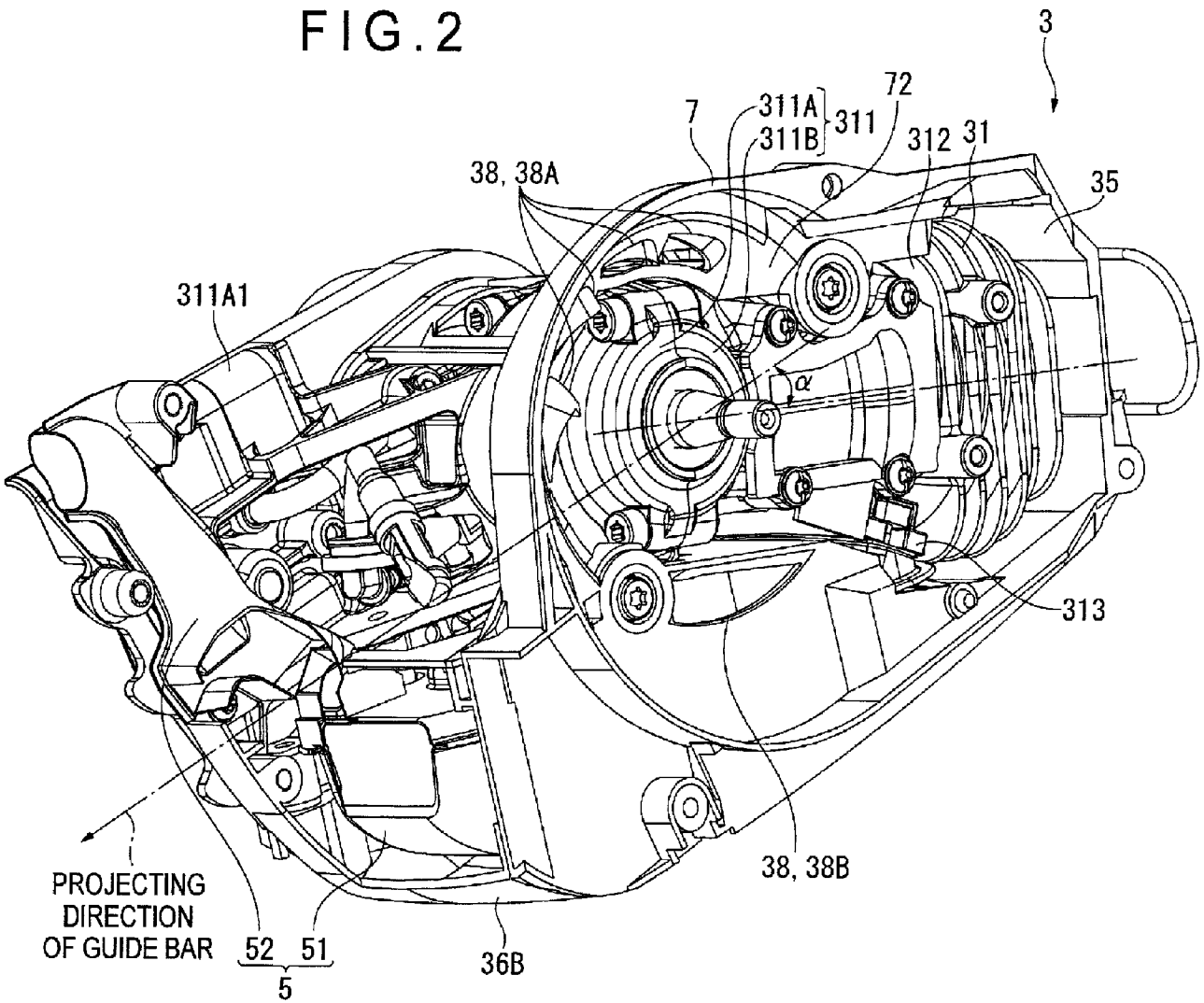
FIG. 2 shows an internal arrangement of a chain saw body according to the exemplary embodiment.

FIG. 2 shows an internal arrangement of the chain saw body 3.

As shown in FIG. 2, the engine 31 is installed in the case body 35 in such a posture that the engine 31 extends rearward from a crankcase 311 disposed substantially at the center of the case body 35 to a cylinder 312 and slightly heads downward toward its rear portion. In other words, the engine 31 is installed in the case body 35 in a transverse posture. Specifically, the engine 31 is installed in the case body 35 while maintaining such a posture that a slanting angle $\alpha$ at which the axis line of the cylinder 312 is slanted from the protruding direction of the guide bar 21 is set at approximately 25 degrees.

The "transverse posture" means a posture of the engine 31 in which the slanting angle $\alpha$ at which the axis line of the cylinder 312 is slanted from the protruding direction of the guide bar 21 is maintained in a range of less than 45 degrees. While the engine 31 is installed in the case body 35 while maintaining such a posture that the slanting angle $\alpha$ at which the axis line of the cylinder 312 is slanted from the protruding direction of the guide bar 21 is set at 25 degrees in this exemplary embodiment, the posture of the engine 31 is not limited thereto. As long as the engine 31 maintains such a posture that the slanting angle $\alpha$ is in the range of less than 45 degrees, the engine 31 may be installed in the case body 35 in any suitable posture.

As shown in FIG. 2, the crankcase 311, which includes a front case 311A and a rear case 311B, is structured to be dividable in halves. The front crankcase 311A (adjacent to the bottom) is formed integrally with a guide bar support 311A1 for supporting the guide bar 21.

Figure 3:
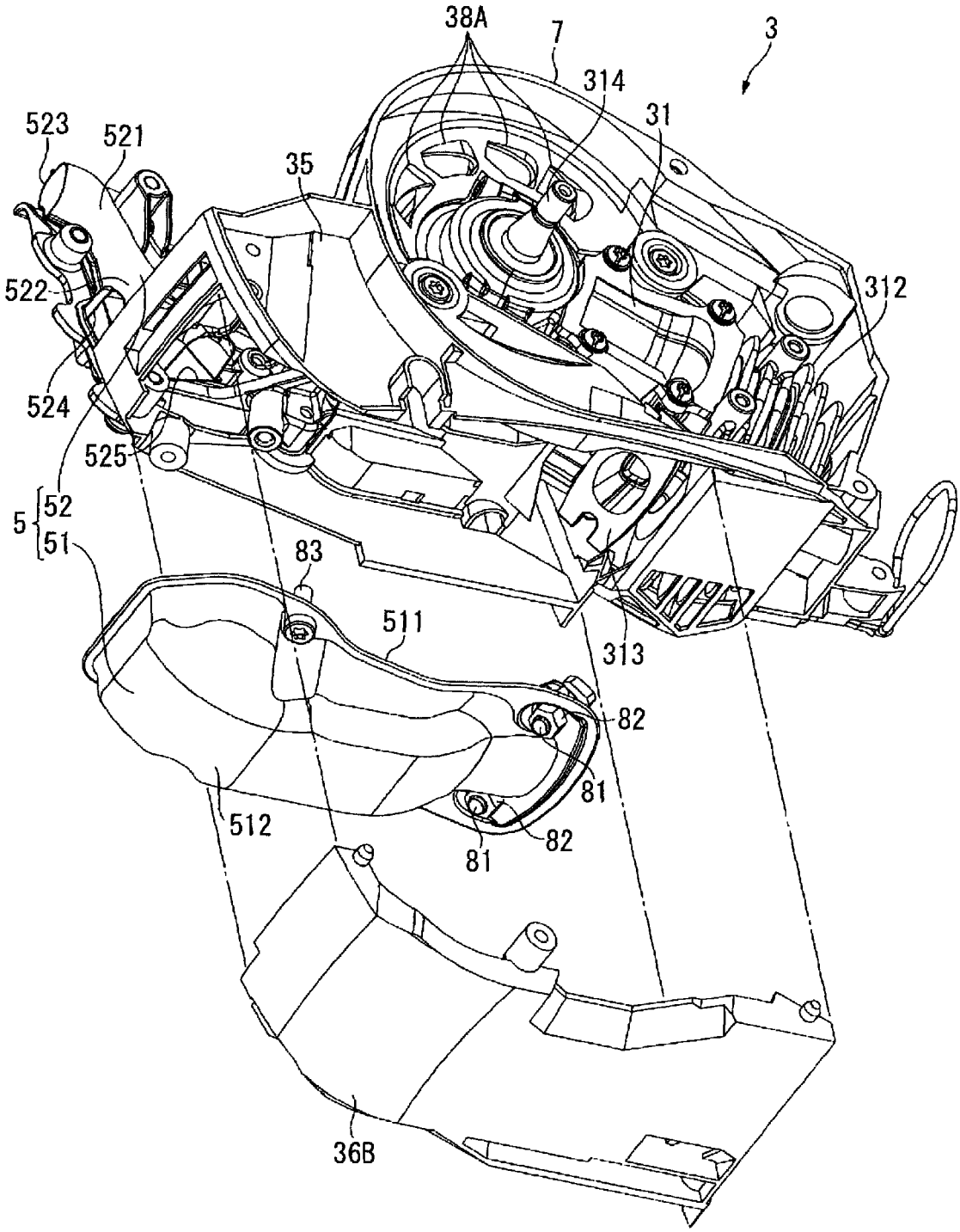
FIG. 3 is an exploded perspective view showing the chain saw body according to the exemplary embodiment.

FIG. 3 is an exploded perspective view showing the chain saw body 3.

As shown in FIG. 3, the lower portion of the engine 31 is provided with an exhaust port 313, and the exhaust port 313 is mounted with the muffler 5. A left end of a crankshaft 314 of the engine 31 is provided with a centrifugal clutch (not shown) for driving the saw chain 22 while a right end of the crankshaft 314 is provided with the cooling fan 6 (see FIG. 4) for cooling the engine 31.

6-1. Arrangement of Cooling Fan

Figure 4:
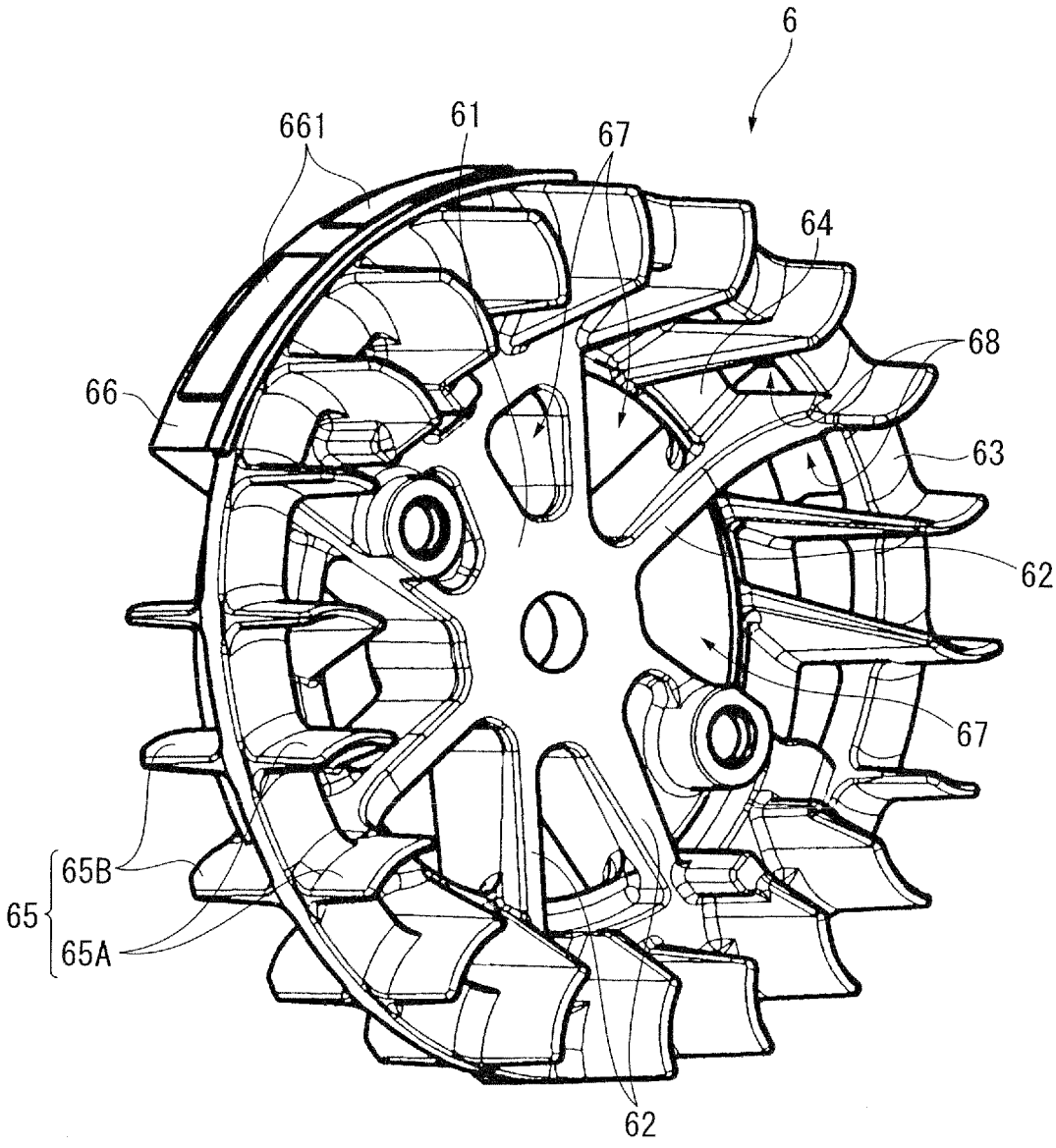
FIG. 4 is a perspective view showing an outward side of a cooling fan according to the exemplary embodiment.
Figure 5:
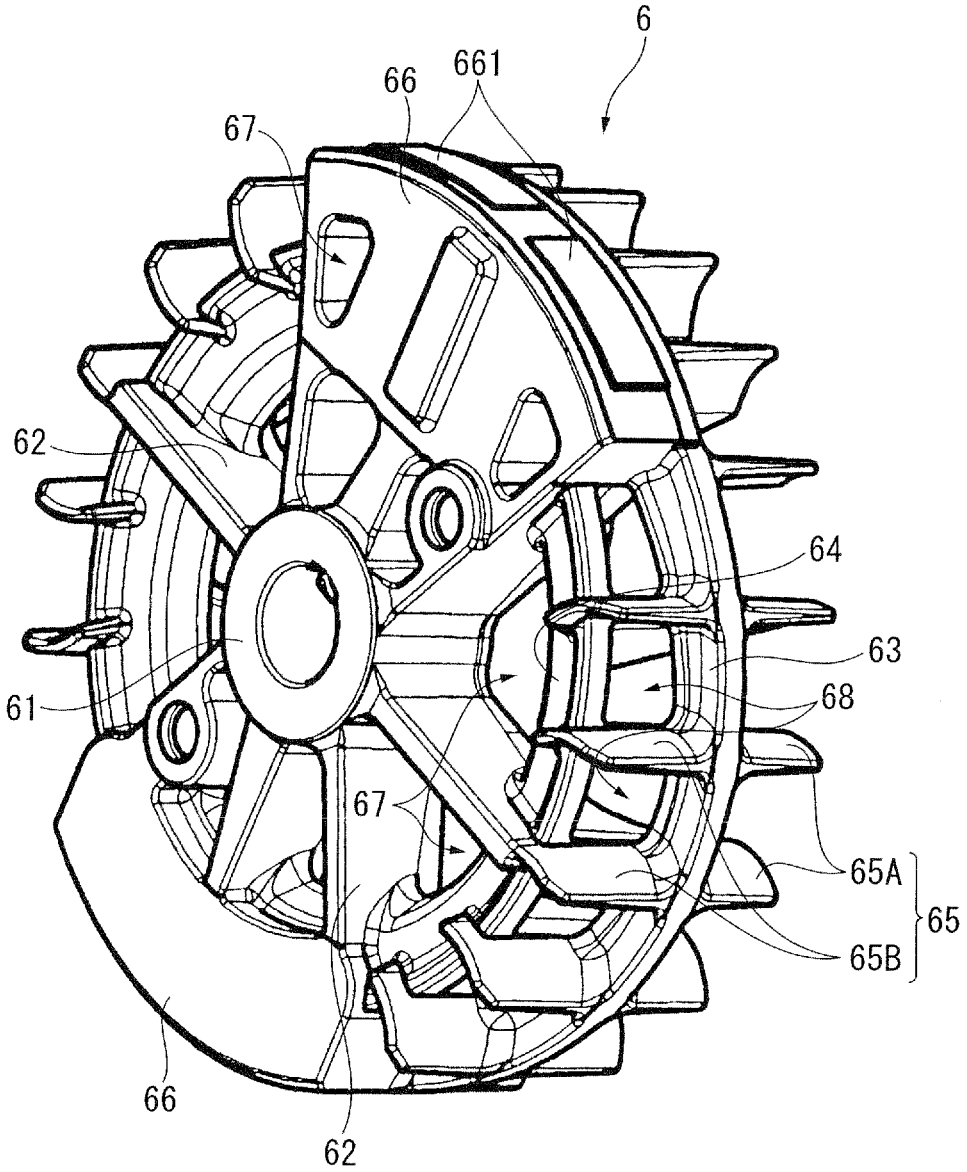
FIG. 5 is a perspective view showing an inward side of the cooling fan according to the exemplary embodiment.
Figure 6:
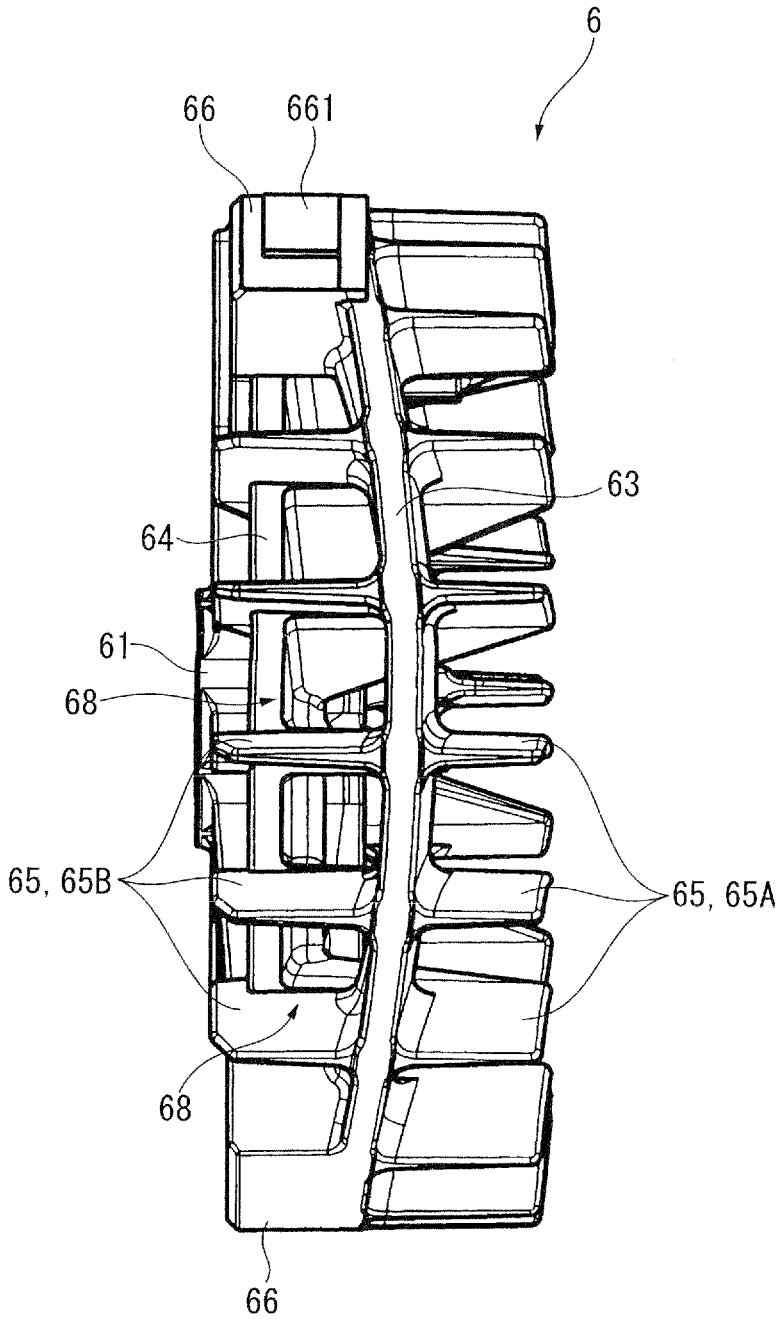
FIG. 6 is a lateral view showing the cooling fan according to the exemplary embodiment.

FIG. 4 is a perspective view showing an outward side of the cooling fan 6. FIG. 5 is a perspective view showing an inward side of the cooling fan 6 and FIG. 6 is a lateral view of the cooling fan 6. A side of the cooling fan 6 not opposed to the crankcase 311 will be referred to as the outward side while a side of the cooling fan 6 opposed to the crankcase 311 will be referred to as the inward side.

As shown in FIGS. 4 to 6, the cooling fan 6 includes: a hub 61 fixed to the crankshaft 314; a plurality of cooling vanes 65 provided along an outer circumference of the hub 61: and annular first and second connectors 63 and 64 for connecting the cooling vanes 65.

The hub 61 is provided with a plurality of large through holes 67 that penetrate the hub 61 in the axial direction. Since the plurality of large through holes 67 are formed in the hub 61 to bore the cooling fan 6 in this exemplary embodiment, a diameter of the cooling fan 6 can be increased without increasing a weight of the cooling fan, so that airflow of the cooling fan 6 can be increased. In the hub 61, portions between the through holes 67 provide a spoke portion 62.

The first connector 63, which is equivalent to a central connector according to an aspect of the invention, connects substantially central portions of the cooling vanes 65 in the right-and-left direction as shown in FIG. 6. The first connector 63 is flexed in a direction toward the outward side of the cooling fan 6 in a bulging manner while circumferentially extending between thick portions 66. According to this exemplary embodiment, this arrangement can increase a section modulus of the cooling fan 6, thereby preventing the cooling fan 6 from being flexed in the direction toward the outward side under the weight of the thick portions 66.

As shown in FIG. 5, the second connector 64 is located closer to axially inner side than the first connector 63 and has a smaller diameter than the first connector 63. In other words, the second connector 64 has such an annular shape as to circumferentially connect inner portions of the cooling vanes 65 and the thick portions 66, thereby reinforcing the cooling fan 6. The second connector 64 is also positioned outwardly in the radial direction of the cooling fan 6 to increase inertia force of the cooling fan 6, thereby contributing to rotation stability of the engine 31.

The cooling vanes 65 are provided so as to bridge the first connector 63 and the second connector 64. The cooling vanes 65 each include: a first cooling vane 65A provided on the outward side of the first connector 63; and a second cooling vane 65B provided on the inward side. As shown in FIG. 5, a plurality of outer circumference holes 68 are defined by the second cooling vanes 65B, the first connector 63 and the second connector 64. Cooling air generated around root portions of the second cooling vanes 65B is ejected through the outer circumference holes 68 outwardly in the radial direction of the cooling fan 6.

The pair of thick portions 66 are provided on the inward side of the first connector 63 to face each other with the central portion of the hub 61 being interposed therebetween. An ignition magnet 661 cooperated with a magnet ignition device (not shown) of the engine 31 is embedded in a first one of the thick portions 66.

6-2. Arrangement of Cooling-Fan Housing

As shown in FIG. 2, the cooling fan 6 is accommodated in a cooling-fan housing 7 that includes: a first cover 71 (see FIG. 1) on the right side cover 36A for covering the outward side of the cooling fan 6; a second cover 72 on the case body 35 for partitioning between the cooling fan 6 and the crankcase 311 and for covering the inward side of the cooling fan 6; and a lateral face of the crankcase 311.

As described above, the first cover 71 is provided with the plurality of first outer-air intakes 37 (see FIG. 1). Air that flows into the cooling-fan housing 7 through the first outer-air intakes 37 is suctioned by the first cooling vanes 65A provided on the outward side of the cooling fan 6 to be conveyed to the cylinder 312 by the first cooling vanes 65A for cooling the cylinder 312.

As shown in FIG. 2, the second cover 72 is provided with a second outer-air intake 38. The second outer-air intake 38 includes: a second upper intake 38A formed in an upper portion of the second cover 72; and a second lower intake 38B formed in a lower portion thereof.

The second upper intake 38A, which is in communication with an upper space in the chain saw body 3, feeds air from the upper side of the crankcase 311 to the inward side of the cooling fan 6. On the other hand, the second lower intake 38B, which is in communication with a lower space in the chain saw body 3, feeds relatively-cool air to the inward side of the cooling fan 6. In this exemplary embodiment, more air is fed to the cooling fan 6 through the second lower intake 38B than through the second upper intake 38A. The second lower intake 38B serves as a main intake of the second outer-air intake 38. The second outer-air intakes 38A, 38B feed the cooling fan 6 with outer air by taking in the outer air through outer-air inlets (not shown) formed on the case cover 36.

Air that (lows into the cooling-fan housing 7 through the second outer-air intakes 38A, 38B is suctioned by the second cooling vanes 65B provided on the inward side of the cooling fan 6 to be conveyed to the cylinder 312 by the second cooling vanes 65B for cooling the cylinder 312.

According to a traditional arrangement, the outer-air inlets for feeding air to the cooling vanes respectively provided on the outward side and the inward side of the cooling fan are easily clogged by a large amount of dust generated during operations. Once such a clogging arises, the cooling vanes provided adjacent to the clogged outer-air inlets can no longer breathe, so that the air flow to the cylinder is unfavorably reduced.

In contrast, in the chain saw 1 according to this exemplary embodiment, the cooling fan 6 is provided with the through holes 67. With this arrangement, even when the outer-air intake(s) 37 or 38 is clogged by dust, the cooling vanes 65A or 65B adjacent to the clogged outer-air intake(s) 37 or 38 can breathe from the non-clogged outer-air intake(s) 37 or 38 (i.e., the other outer-air intake(s)) through the through holes 67. Accordingly, even when the outer-air intake(s) 37 or 38 is clogged, reduction in the air flow to the cylinder 312 can be restrained.

In addition, since the cooling vanes 65A, 65B are provided on both sides of the cooling fan 6, the cooling vanes 65A or 65B adjacent to the non-clogged outer-air intake(s) 37 or 38 can breathe directly from the non-clogged outer-air intake(s) 37 or 38 without using the through holes 67.

As compared to an arrangement where the cooling fan is provided with the cooling vanes 65 only on the side adjacent to the clogged outer-air intake(s) 37 or 38, this exemplary embodiment can enhance breathing efficiency of the cooling fan 6 all the more because the cooling vanes 65A or 65B adjacent to the non-clogged outer-air intake(s) 37 or 38 can breathe directly from the non-clogged outer-air intake(s) 37 or 38 without using the through holes 67. Thus, reduction in air flow due to clogging of the outer-air intakes can be further restrained.

7-1. Overall Arrangement of Muffler

Figure 7:
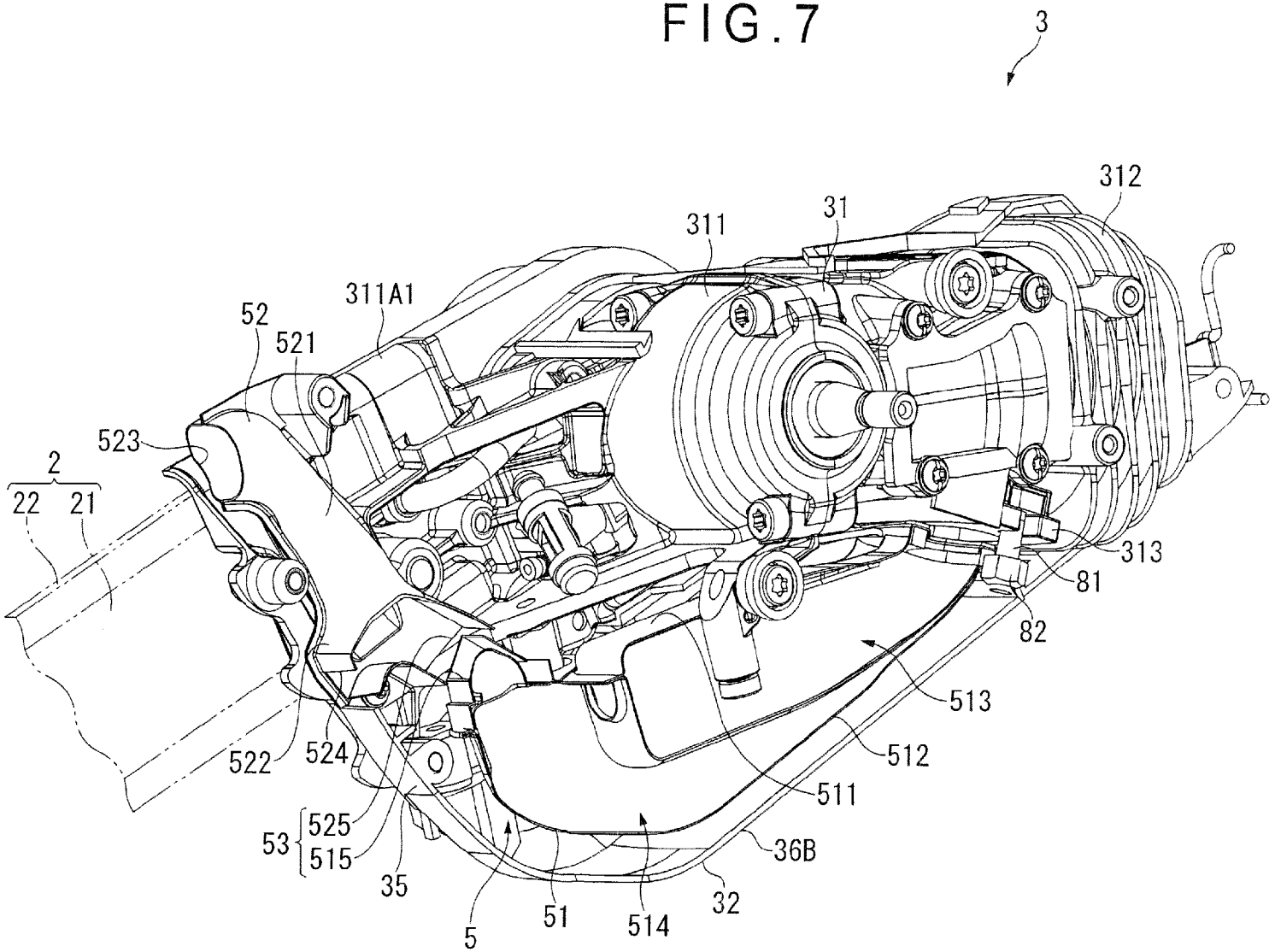
FIG. 7 is a perspective view showing the chain saw body according to the exemplary embodiment, in which a muffler is shown in cross section.

FIG. 7 is a perspective view showing the chain saw body 3, in which the muffler 5 is shown in cross section.

As shown in FIGS. 3 and 7, the muffler 5 includes: a muffler body 51 connected to the engine 31; and a passage 52 mounted on the guide bar support 311A1 and communicated with the muffler body 51.

7-2. Arrangement of Muffler Body

As shown in FIGS. 3 and 7, the muffler body 51 is accommodated in a space within the chain saw body 3 which extends from the lower side to the front side of the engine 31. The muffler body 51, which includes: an upper face 511 slanted substantially at the same slanting angle as the slanting angle $\alpha$ of the cylinder 312; and a lower face 512 shaped to follow the inner face of the muffler cover 36B, is shaped like a box. The muffler body 51 is internally provided with two muffling chambers 513, 514. A front portion of the upper face 511 is provided with an outlet 515.

A rear portion of the muffler body 51 is penetrated by a pair of bolts 81 that outwardly project from the exhaust port 313. By threading a nut 82 into each of the bolts 81, the rear portion of the muffler body 51 is fixed to the exhaust port 313. On the other hand, a front portion of the muffler body 51 is penetrated by a pair of bolts 83 inserted from the lower side. By threading the bolts 83 into the crankcase 311, the front portion of the muffler body 51 is fixed to the crankcase 311. Specifically, the muffler body 51 according to this exemplary embodiment is attachable to and detachable from the chain saw body 3 from the lower side of the chain saw body 3. i.e., detachably mounted on the chain saw body 3. The muffler body 51 is covered with the muffler cover 36B. The muffler cover 36*b* is detachably mounted on the case body 35. The muffler cover 36 is sized sufficiently enough for the muffler body 51 to be attachable on the chain saw body 3 when the muffler cover 36B is detached from the case body 35.

According to a traditional arrangement particularly of a small-size chain saw, the muffler is inserted in the case body from the lateral side to be installed in the case body and the engine. Detachment of the muffler in such an arrangement necessitates detachment of a large side cover for covering the lateral side of the engine and detachment of various components mounted on the lateral side of the engine. Thus, replacement and maintenance of the muffler have been effort-consuming.

In contrast, in the chain saw 1 according to this exemplary embodiment, a portion for covering the muffler body 51 is arranged as the separately-detachable muffler cover 36B. In addition, the muffler body 51 is mounted on the chain saw body 3 in a manner detachable from the lower side of the chain saw body 3. Thus, by merely detaching the muffler cover 36B, the muffler body 51 can be attached to or detached from the chain saw body 3, thereby facilitating replacement and maintenance of the muffler body 51.

7-3. Arrangement of Passage

The passage 52 is for ejecting exhaust gas having passed through the muffler body 51 to the outside of the chain saw body 3 As shown in FIG. 7, the passage 52 includes: a main passage 521 upwardly extending from the front side of the muffler body 51 and opened at a front upper side of the chain saw body 3; and a sub passage 522 branched from the main passage 521 and opened at a front lower side of the chain saw body 3.

Specifically, in the front side of the chain saw body 3, the main passage 521 is opened in the upper vicinity of a root portion from which the guide bar 21 projects from the chain saw body 3 while the sub passage 522 is opened in the lower vicinity of the root portion of the guide gar 21. The opening of the main passage 521 which is open frontward serves as the main exhaust outlet 523 of the passage 52 while the opening of the sub passage 522 which is open frontward serves as the sub exhaust outlet 524 of the passage 52.

The passage 52 is in communication with the muffler body 51 through an ejector 53. Specifically, a small clearance is formed between an inlet 525 (i.e. an opening of the passage 52 adjacent to a root portion of the passage 52) and the outlet 515 of the muffler body 51, and the passage 52 and the muffler body 51 are in communication with each other through the ejector 53 that includes the inlet 525 and the outlet 515 opposed to each other with the clearance interposed therebetween.

7-4. Flow of Exhaust Gas

Flow of exhaust gas ejected from the engine 31 will be described below.

The exhaust gas ejected from the engine 31 passes through the muffling chambers 513, 514 within the muffler body 51 to be subjected to muffling, and is ejected from the outlet 515 to the inlet 525 of the main passage 521. At this time, cool air in the vicinity of the ejector 53 is caught in the flow of the exhaust gas and suctioned into the clearance between the outlet 515 and the inlet 525 by the exhaust gas to be mixed with the exhaust gas.

Since the exhaust gas flows upwardly by nature, the exhaust gas having flown into the main passage 521 in a manner described above flows through the main passage 521 in a usual state for frontward ejection from the main exhaust outlet 523. Then, the exhaust gas passes through the main exhaust outlet (not shown) provided in the case cover 36 to be ejected to the outside frontward of the chain saw body 3. On the other hand, when the main exhaust outlet 523 is clogged by a large amount of dust and the like generated during operations, the exhaust gas having flown into the main passage 521 flows into the sub passage 522 at the branched section for frontward ejection from the sub exhaust outlet 524 opened at the front lower side of the chain saw body 3. Subsequently, the exhaust gas passes through the sub exhaust outlet (not shown) provided in the case cover 36 to be ejected to the outside frontward of the chain saw body 3.

As described above, in the chain saw 1 according to this exemplary embodiment, since the exhaust outlets 523 and 524 are provided in the front face of the chain saw body 3, the exhaust gas can be ejected frontward of the chain saw body 3. With this arrangement, exhaust sound can be dispersed frontward, so that an operator hears less exhaust sound. Thus, working environment can be improved.

In addition, since the exhaust gas is ejected to the outside in a usual state after passing through the long main passage 521 that extends upwardly from the muffler body 51, the exhaust gas can be cooled down. Thus, an edge of the main exhaust outlet formed on the ease cover 36 made of synthetic resin can be prevented from being discolored or deformed by heat of the exhaust gas.

Since the passage 52 and the muffler body 51 are in communication with each other through the ejector 53, cool air in the vicinity of the ejector 53 can be mixed into the exhaust gas, thereby directly and favorably cooling the exhaust gas. Thus, edges of the main exhaust outlet and the sub exhaust outlet formed in the case cover 36 can be reliably prevented from being discolored or deformed by heat of the exhaust gas.

Further, the main exhaust outlet 523 of the passage 52 is disposed upwardly adjacent to the root portion of the guide bar 21, so that the main exhaust outlet 523 can eject the exhaust gas in a usual state from the upper vicinity of the root portion from which the guide bar 21 projects. Thus, as compared to an arrangement where the exhaust gas is ejected from the lower vicinity of the root portion of the guide bar 21, dust can be restrained from floating in the air due to the driving of the saw chain 22.

In addition, the passage 52 includes the sub passage 522. Thus, even when the main exhaust outlet 523 is clogged by dust and the like, the exhaust gas can be ejected from the sub exhaust outlet 524. Accordingly, even when the main exhaust outlet 523 is clogged, exhaust efficiency can be favorably maintained. Further, since the exhaust gas can be ejected from the sub exhaust outlet 524, no exhaust gas counterflows into the chain saw body 3 from the clearance of the ejector 53.

8. Modification(s) of Exemplary Embodiment(s)

It should be noted that, although the best structure, method and the like for implementing the invention have been disclosed in the above description, the invention is not limited to the above description. Specifically, while the invention has been described above with a specific embodiment(s) being particularly illustrated and mainly described, those skilled in the art may make various modifications to the above-described embodiment in terms of a shape, quantity or any other detailed configuration without departing from a scope of a technical idea and an object of the invention.

Thus, a shape, quantity and the like described above merely serve as exemplifying the invention for facilitating an understanding of the invention, and do not serve as any limitations on the invention, so that what is described by a name of a component for which the description of the shape, quantity and the like are partially or totally omitted is also included in the invention.

For instance, while the cooling vanes 65A, 65B are provided both on the outward side and the inward side of the cooling fan 6, the cooling vanes may be provided only on either one of the outward side and the inward side of the cooling fan 6.

The Japanese application Number JP2007-181172 upon which this patent application is based is hereby incorporated by reference.

What is claimed is:

1. A chain saw, comprising:

an engine;

a cooling fan which is disposed on a lateral side of a crankcase of the engine, and which is rotationally driven by the engine; and a case that accommodates the engine and the cooling fan, wherein the cooling fan includes:

a hub fixed on a crankshaft of the engine;

a plurality of cooling vanes provided along an outer circumference of the hub; and an annular connector that connects the cooling vanes, wherein the case includes:

a first cover that covers an outer side of the cooling fan; and a second cover that covers an inner side of the cooling fan, wherein the first cover is provided with a first outer-air intake that feeds outer air to the outer side of the cooling fan, and the second cover is provided with a second outer-air intake that feeds outer air to the inner side of the cooling fan, wherein the hub is provided with a through hole that axially penetrates the hub and intercommunicates the outer side and the inner side of the cooling fan, wherein the hub comprises spoke portions which extend radially outward from a center of the hub, the spoke portions being provided as structures different from the annular connector and the cooling vanes, the through hole being provided between two adjacent spoke portions, wherein the connector includes:

an annular first connector that connects substantially central portions of the cooling vanes; and an annular second connector which is located axially closer to the inner side of the cooling fan than the first connector, wherein the first connector and the second connector are both ring-shaped, wherein the first connector and the second connector are connected to radially distal ends of the spoke portions of the hub, and wherein the cooling vanes are connected to the second connector such that radially proximal ends of the cooling vanes closest to the center of the hub extend toward the center of the hub not farther than a radially proximal end of the second connector which is closest to the center of the hub.

2. The chain saw according to claim 1, wherein the inner side of the first connector is provided with a pair of thick portions formed to be thick, an ignition magnet is accommodated in a first one of the pair of thick portions, and the first connector extends between the pair of thick portions while being flexed to outwardly bulge.

3. The chain saw according to claim 1, wherein the hub is provided with a plurality of the through holes that axially penetrate the hub and intercommunicate the outer side and the inner side of the cooling fan.

4. The chain saw according to claim 1, wherein the first connector is located substantially at an axial center of the cooling fan, wherein the first and second connectors have different diameters, and wherein a plurality of radial circumferential holes for radially ejecting cooling air therethrough are defined by the cooling vanes and the first and second connectors.

5. The chain saw according to claim 1, wherein the first connector connects the cooling vanes at a position which is radially different from a position at which the second connector connects the cooling vanes.

6. The chain saw according to claim 2, wherein the first connector is flexed to outwardly bulge such that at a portion thereof furthest from a radial center of the cooling fan, an axial position of the first connector is closest to the inner side of the fan at a circumferential position of either of the pair of thick portions, and is closest to the outer side of the fan at a circumferential position corresponding to a midpoint between the pair of thick portions in a circumferential direction.

7. The chain saw according to claim 5, wherein the first connector connects the cooling vanes at a position farther from a radial center of the cooling fan than a position at which the second connector connects the cooling vanes.

8. The chain saw according to claim 1, wherein the cooling vanes each include:

a first cooling vane provided on an outer side of the first connector; and a second cooling vane provided on an inner side of the first connector.

9. The chain saw according to claim 8, wherein the second cooling vanes are connected to the second connector at radially proximal ends thereof, and the second cooling vanes are not in contact with the second connector at radial distal ends thereof.

10. The chain saw according to claim 9, wherein all of a portion of the second cooling vanes in a radial direction thereof at an axial position of the first connector are in contact with the first connector.

11. The chain saw according to claim 4, wherein the spoke portions include axially extending portions which extend between radially distal end portions of the second connector and radially proximal portions of the first connector.

* * * * *